US009718213B2

(12) United States Patent
Hébert

(10) Patent No.: US 9,718,213 B2
(45) Date of Patent: Aug. 1, 2017

(54) FILLER APPARATUS AND METHOD OF USING THE SAME

(71) Applicant: Louis Hébert, Saint-Urbain Premier (CA)

(72) Inventor: Louis Hébert, Saint-Urbain Premier (CA)

( * ) Notice: Subject to any disclaimer, the term of this patent is extended or adjusted under 35 U.S.C. 154(b) by 316 days.

(21) Appl. No.: 14/497,055

(22) Filed: Sep. 25, 2014

(65) Prior Publication Data

US 2015/0083231 A1 Mar. 26, 2015

Related U.S. Application Data

(60) Provisional application No. 61/882,128, filed on Sep. 25, 2013.

(51) Int. Cl.
*B28B 13/02* (2006.01)

(52) U.S. Cl.
CPC ..... *B28B 13/02* (2013.01); *Y10T 137/0402* (2015.04); *Y10T 137/4245* (2015.04); *Y10T 137/598* (2015.04)

(58) Field of Classification Search
CPC B28B 13/02; Y10T 137/0402; Y10T 137/598
See application file for complete search history.

(56) References Cited

U.S. PATENT DOCUMENTS 2,589,115 A * 3/1952 Nelson ..... B28B 3/022 425/157
3,331,112 A * 7/1967 Clanton ..... B28B 3/022 425/253
3,590,446 A * 7/1971 Sonneville ..... B28B 1/10 425/125
3,602,394 A * 8/1971 McCune ..... B65D 88/68 222/240
3,659,986 A * 5/1972 Gelbman ..... B28B 5/04 425/123
3,874,832 A * 4/1975 Ohta ..... B28B 15/00 280/33.998

(Continued)

*Primary Examiner* — James Sanders
(74) *Attorney, Agent, or Firm* — Benoit & Cote, Inc.; C. Marc Benoit

(57) ABSTRACT

The present document describes filler apparatus, washing and maintenance support station and methods of using the same. The support station is for supporting a filler container, a volumetric container and/or a sliding plate of the filler apparatus. The washing and maintenance support station comprises a support main frame; a filler container corresponding mating connector on the support main frame for releasably connecting with a filler container mating connector; a volumetric container mount receiving section on the main frame below the filler container corresponding mating connector for releasably mounting a volumetric container mount; and a sliding plate receiving support on the main frame below the volumetric container mount receiving section for releasably supporting a sliding plate substantially flat section. When displaced vertically relative to the support main frame, the filler container, the volumetric container and the sliding plate are capable of engagement with respectively the filler container corresponding mating connector, the volumetric container mount receiving section and the sliding plate receiving support to be disengaged.

9 Claims, 11 Drawing Sheets

(56) References Cited

U.S. PATENT DOCUMENTS

| | | | | |
|---|---|---|---|---|
| 7,988,929 | B2 * | 8/2011 | Limback | A47L 15/4436<br>137/268 |
| 2001/0038018 | A1 * | 11/2001 | Bell | G01G 13/16<br>222/58 |
| 2004/0226961 | A1 * | 11/2004 | Mehus | B01F 1/0027<br>222/77 |

* cited by examiner

FILLER APPARATUS AND METHOD OF USING THE SAME

CROSS-REFERENCE TO RELATED APPLICATIONS

This application claims priority of U.S. provisional patent application No. 61/882,128 filed on Sep. 25, 2014, the specification of which is hereby incorporated by reference.

BACKGROUND (a) Field

The subject matter disclosed generally relates to molding processes and molding apparatus for molding concrete articles. More particularly, the subject matter relates to filler apparatus, to washing and maintenance support stations for receiving parts of filler apparatus and to methods of using the same.

(b) Related Prior Art

Concrete articles (i.e., such as concrete articles for gardens, driveways, landscape designs, veneer products, roof tile products, building work and masonry products and the like) are typically molded at high speed in molding stations, which incorporate a filling station, and the filling of and molding in the mold are usually performed at the same location.

There exists in the prior art filler apparatus. However, filler apparatus of the prior art are usually not configured such as to provide convenience in washing and/or maintenance for an operator of the molding process.

There is therefore a need for improved filler apparatus, for supports for receiving parts of the filler apparatus and for methods of using the same that allows for an improved and/or easier washing/reparation process of the different parts provided in the filling apparatus.

SUMMARY

According to an embodiment, there is provided a filler apparatus to be mounted on at least one of: a main frame and a washing and maintenance support station defining a mount receiving section extending therefrom, the filler apparatus comprising: a filler container to be releasably connected to the at least one of: a main frame and a support station for receiving a moldable material; a volumetric container to be releasably mounted on the mount receiving section of the at least one of: a main frame and a support station below the filler container; and a sliding plate to be releasably supported by the at least one of: the main frame and the support station below the volumetric container; wherein the filler container, the volumetric container and the sliding plate are releasably engageable and disengageable to and from the at least one of: the main frame and the support station as a single sub-assembly for at least one of: cleaning, maintenance and replacement procedures.

According to an embodiment there is provided a filler apparatus to be mounted on at least one of a main frame and a support station defining a mount receiving section extending therefrom, the filler apparatus comprising: a sliding plate; a volumetric container adapted for releasable engagement with and above the sliding plate; and a filler container for receiving a moldable material and adapted for releasable engagement with and above the volumetric container, the volumetric container for receiving the moldable material from the filler container; wherein at least one of the filler container, the volumetric container and the sliding plate is adapted for releasable mounting and alignment with the mount receiving section of the at least one of the main frame and the support station; and further wherein the filler container, the volumetric container and the sliding plate are, when displaced vertically, releasably engageable to and disengageable from the at least one of the main frame and the support station as a single sub-assembly.

According to an embodiment, the filler container, the volumetric container and the sliding plate are simply laid on top of each other and therefore disengaged from each other by hanging the top layer, then the middle layer and finally the bottom layer. Gravity therefore acts as the force to separate/disengage the parts of the filler apparatus.

According to another embodiment, the filler container further comprises a supporting plate defining a mating connector for releasably connecting with a corresponding mating connector on the support station.

According to a further embodiment, the mating connector comprises a plurality of mating connectors for releasably connecting with a plurality of mating connectors on the support station.

According to yet another embodiment, the corresponding mating connector comprises at least one of: a hook section and a latch section, and further wherein the mating connector comprises an opening for releasably connecting with the at least one of: a hook section and a latch section.

According to another embodiment, the volumetric container comprises a mount for releasably mounting on the mount receiving section of the at least one of: a main frame and a support station.

According to a further embodiment, the mount comprises a plurality of mounts for releasably mounting on a plurality of mount receiving sections of the at least one of: a main frame and a support station.

According to yet another embodiment, the sliding plate comprises a substantially flat section to be supported by a receiving support of at least one of: the main frame and the support station.

According to another embodiment, there is provided a washing and maintenance support station for supporting at least one of: a filler container, a volumetric container and a sliding plate of a filler apparatus, the filler container having a filler container mating connector, the volumetric container having a volumetric container mount, the sliding plate having a sliding plate substantially flat section, the washing and maintenance support station comprising: a support main frame; a filler container corresponding mating connector on the support main frame for releasably connecting with the filler container mating connector; a volumetric container mount receiving section on the main frame below the filler container corresponding mating connector for releasably mounting the volumetric container mount; and a sliding plate receiving support on the main frame below the volumetric container mount receiving section for releasably supporting the sliding plate substantially flat section; wherein when displaced downwardly relative to the support main frame, the filler container, the volumetric container and the sliding plate are capable of engagement with respectively the filler container corresponding mating connector, the volumetric container mount receiving section and the sliding plate receiving support to be disengaged.

According to a further embodiment, the filler container corresponding mating connector comprises a plurality of filler container corresponding mating connectors, each one of the plurality of filler container corresponding mating connectors extending upwardly from an upper portion of the support main frame.

According to yet another embodiment, the filler container corresponding mating connector comprises at least one of: a hook section and a latch section for releasably connecting with an opening defined by the filler container mating connector.

According to another embodiment, the at least one of: a hook section and a latch section comprises a support portion and an engagement portion pivotally extending from the support portion, and further wherein the engagement portion is capable of pivoting relative to the support portion between an engaged position where the at least one of: a hook section and a latch section is releasably connected with the opening and a disengaged position.

According to a further embodiment, the at least one of: a hook section and a latch section comprises four hook sections or four latch sections for releasably connecting with four openings defined by the filler container mating connector.

According to yet another embodiment, the volumetric container mount receiving section comprises a plurality of volumetric container mount receiving sections for releasably mounting a plurality of volumetric container mounts, each one of the plurality of volumetric container mount receiving sections extending outwardly from an external frame portion of the support main frame.

According to another embodiment, each one of the plurality of volumetric container mount receiving sections comprises a first plate member and a second plate member distant from the first plate member, the first and second plate members defining a mounting passage for receiving a corresponding volumetric container mount of the plurality of volumetric container mounts.

According to a further embodiment, the volumetric container mount receiving section further comprises a substantially flat receiving section for receiving a bottom portion of the volumetric container.

According to yet another embodiment, the sliding plate receiving support comprises a plurality of sliding plate receiving supports, each one of the plurality of sliding plate receiving supports inwardly extending from the support main frame for defining a receiving plan for horizontally supporting the sliding plate.

According to another embodiment, the support main frame defines a passage for allowing the at least one of: a filler container, a volumetric container and a sliding plate of a filler apparatus to access an internal section defined by the support main frame.

According to another embodiment, there is provided a method for at least one of: washing and maintaining a filler container, a volumetric container and a sliding plate of a filler apparatus, the method comprising: displacing downwardly relative to a support main frame the filler container, the volumetric container and the sliding plate while; firstly engaging the filler container with the support main frame; secondly engaging the volumetric container with the support main frame below the filler container; and thirdly engaging the sliding plate with the support main frame below the volumetric container.

According to a further embodiment, the method further comprises at least one of: washing and maintaining at least one of: the filler container, the volumetric container and the sliding plate According to yet another embodiment, the method further comprises displacing upwardly relative to the support main frame the sliding plate; displacing upwardly relative to the support main frame the sliding plate supporting the volumetric container; and displacing upwardly relative to the support main frame the sliding plate and the volumetric container supporting the filler container.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed filler apparatus, washing and maintenance support stations for receiving parts of filler apparatus and methods of using the same.

Figure 1:
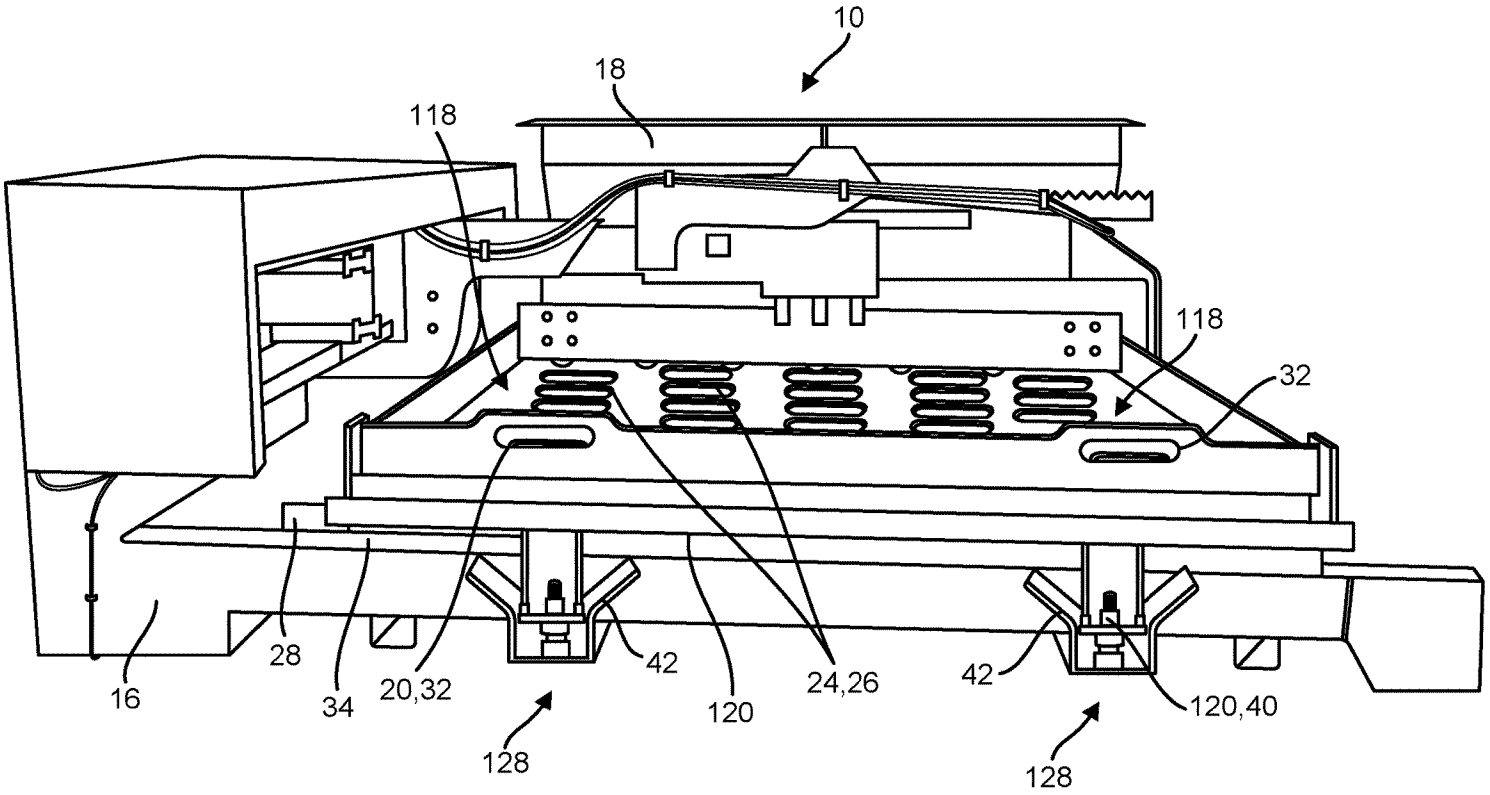
FIG. 1 illustrates a filler apparatus in accordance with an embodiment.
Figure 2:
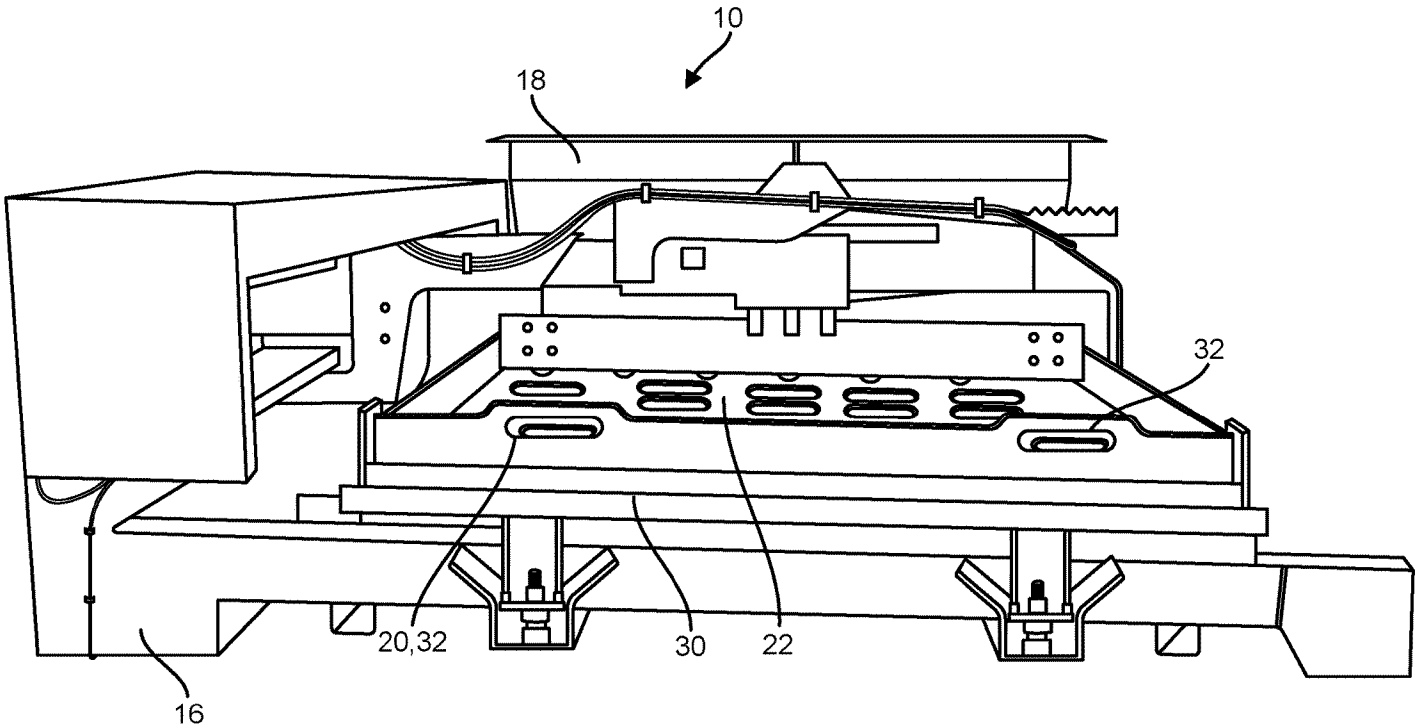
FIG. 2 further illustrates the filler apparatus of FIG. 1.
Figure 3:
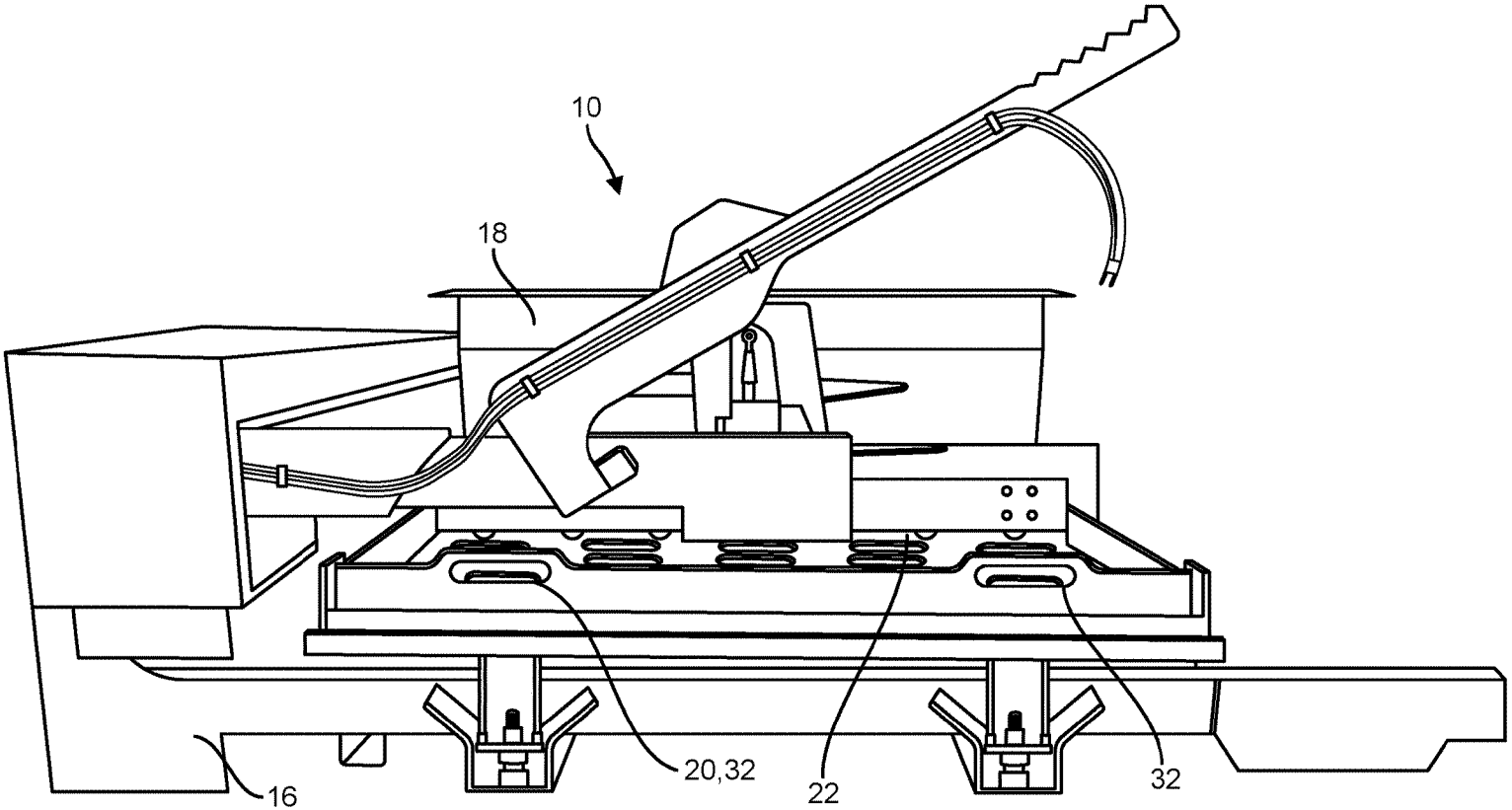
FIG. 3 further illustrates the filler apparatus of FIG. 1.
Figure 4:
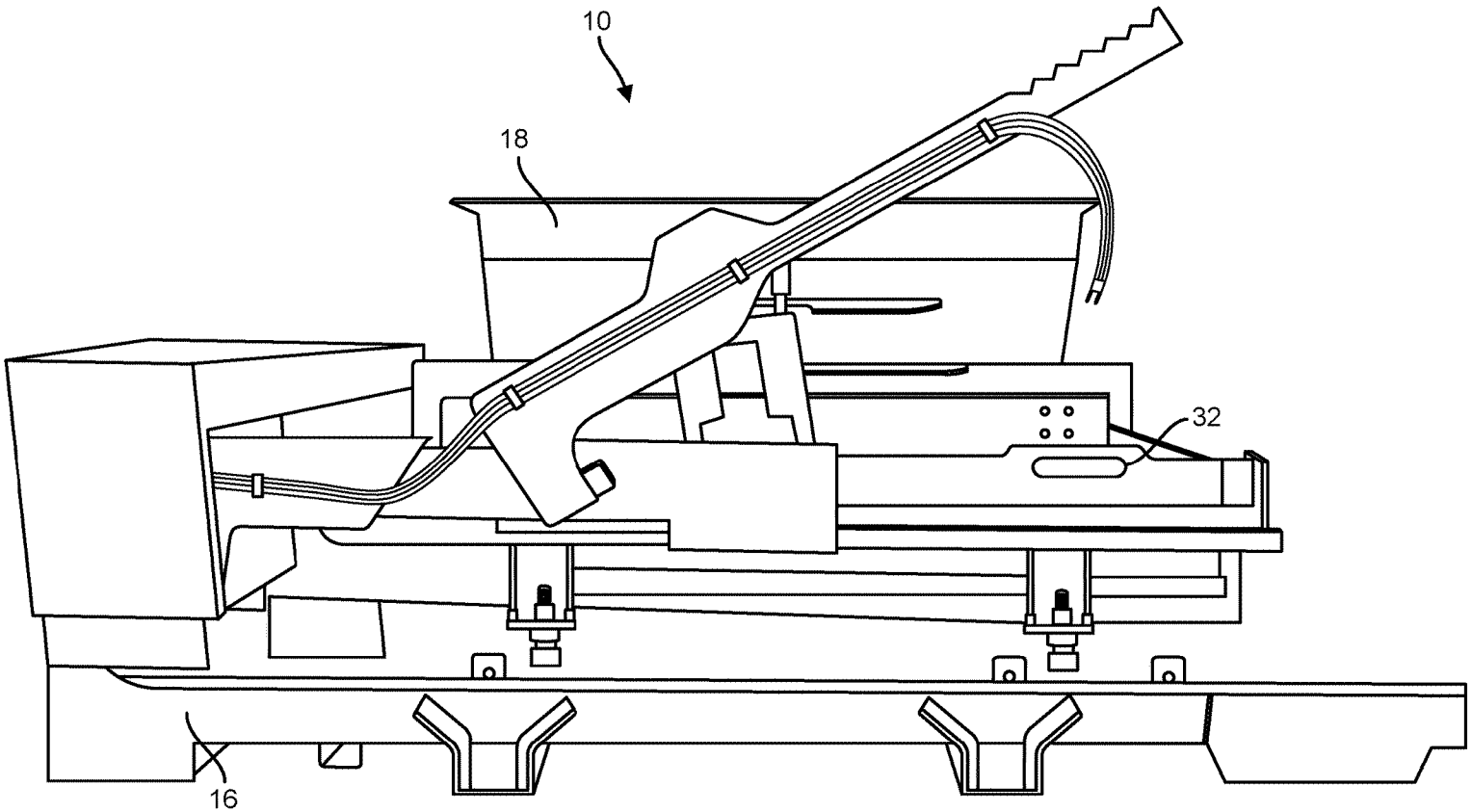
FIG. 4 further illustrates the filler apparatus of FIG. 1.

Referring now to the drawings, and more particularly to FIGS. 1-4, there is shown a filler apparatus 10 in accordance with an embodiment.

In a molding process of molding articles, a mold (not shown) defining a mold volume (not shown) circulates, or is positioned, below a filler apparatus 10 of the molding process for receiving a moldable material (not shown), such as a wet or a dry moldable material. The wet or dry moldable material may include, without limitation, concrete, composite concrete and the like. The mold may include one cavity or a plurality of cavities having the same cavity volume or cavities of different volumes. The one or more cavities may have a plurality of different shapes such as to form a plurality of concrete articles of different shapes and configurations. These concrete articles may be installed in garden and/or driveway areas, used in the creation of landscaping designs, may be veneer products, roof tile products, building work and masonry products and the like.

In accordance with an embodiment, the mold may be conveyed via a conveyor (not shown) below the filler apparatus 10.

The filler apparatus 10 includes a main frame 16 and a filler container 18. The filler container 18 is slidably and releasably in engagement with the main frame 16 for receiving the moldable material. The filler container 18 is slidable between a first position (i.e., where the filler container 18 is being filled with the moldable material) and a second position (i.e., where the filler container 18 pours the moldable material on a volumetric container 22). The filler container 18 further defines an opening 20 for providing the moldable material to exit the filler container 18 towards the volumetric container 22 below the filler container 18. The filler apparatus 10 further includes a volumetric container 22 releasably mounted on the main frame 16 below the filler container 18. The volumetric container 22 includes one or a plurality of mold openings 24 where each mold opening 24 defines a mold opening volume 26 which is substantially equivalent to a mold volume defined by the mold (i.e., each one of the plurality of mold openings 24 corresponds to a corresponding cavity (not shown) of the plurality of cavities of the mold). Each mold opening 24 is for receiving the moldable material, which exits the opening 20 of the filler container 18. The filler apparatus 10 further includes a sliding plate 28 slidably and releasably supported to the main frame 16 below the volumetric container 22. The sliding plate 28 is slidable between a filling position and a releasing position.

In operation of the filler apparatus 10, when the sliding plate 28 is in the filling position, the sliding plate 28 blocks the mold opening(s) 24 of the volumetric container 22 to form a mold section (or mold sections) for receiving the moldable material. On the other hand, when the sliding plate 28 is in the releasing position, the moldable material may be released from the mold opening(s) 24 of the volumetric container 22, thereby allowing the moldable material to be released into the mold below the volumetric container 22 (i.e., the mold can travel below the filler apparatus 10 on a conveyor).

It is to be noted that one of the advantages of the filler apparatus 10 is that, according to its configuration, it can be assembled and disassembled very quickly and in a single sub-assembly unit for maintenance, cleaning and/or replacement procedures.

Thus, at least one of the filler container 18, the volumetric container 22 and the sliding plate 28 may be released, detached, demounted or disconnected from the main frame 16 of the filler apparatus 10. Then, the filler container 18, the volumetric container 22 and/or the sliding plate 28 may be uninstalled at any moment from the main frame 16 such as a washing and/or a repairing/maintenance process may be provided to these parts (i.e., the filler container 18, the volumetric container 22 and the sliding plate 28) of the filler apparatus 10. When the filler container 18, the volumetric container 22 and the sliding plate 28 are detached, demounted, disengaged and/or disconnected from the main frame 16, the process can still operate using alternative filler containers 18, volumetric containers 22 and/or sliding plates 28.

As shown, the filler apparatus 10 further includes a supporting plate 30 for supporting the filler container 18. The supporting plate 30 includes mating connectors 118 for releasably connecting with corresponding mating connectors 126 of a washing and maintenance support station 100 (as described below) for receiving parts of the filler apparatus 10. The supporting plate 30 may include a plurality of mating connectors 118. As shown, the supporting plate 30 has four openings 32 for connecting with the corresponding mating connectors 126 of the washing and maintenance support station 100. It is to be mentioned that is it possible to use two or more filler apparatus 10 for face mixing processes.

As also shown, the volumetric container 22 includes a frame 34, which has mounts 120 for releasably mounting to the mount receiving sections 128 of the washing and maintenance support station 100. The frame 34 may include a plurality of mounts 120 or one mount 120. As shown, the frame 34 has four downwardly extending legs 40 for corresponding with the corresponding mount receiving sections 128 of the washing and maintenance support station 100. According to an embodiment, the mount receiving sections 128 are v-shaped in order to facilitate mounting and unmounting with the mounts 120. The mount receiving sections 128 (v-shaped or not, or having another shape adapted to fulfill the same function) are also used as guides for aligning the filler apparatus 10 with the main frame 16 or the support station 100 upon engagement and disengagement of the filler container 18, the volumetric container 22 and the sliding plate 28.

As also shown, the sliding plate 28 defines a substantially flat section 36 to be received by a receiving support 38 of the washing and maintenance support station 100.

It is to be noted that the mating connectors 118, the corresponding mating connectors 126, the mounts 120, the mount receiving sections 128, the substantially flat section 36 and the receiving support 38 of the filler container 18, the volumetric container 22, the sliding plate 28 and the washing and maintenance support station 100 may be of any shape and configuration such as to correspond with a corresponding mating connector/mount receiving section/receiving support and allowing the parts (i.e., filler container 18, volumetric container 22 and sliding plate 28) to be received, engaged, connected, mounted and/or supported by the washing and maintenance support station 100.

According to another embodiment, the hook section and/or the latch section of the corresponding mating connector 126 may include a support portion 200 and an engagement portion 202 pivotally extending from the support portion 200. The engagement portion 202 is capable of pivoting relative to the support portion 200 between an engaged position where the hook section and/or the latch section of the corresponding mating connector 126 is releasably connected with the opening 20 and a disengaged position.

Figure 5:
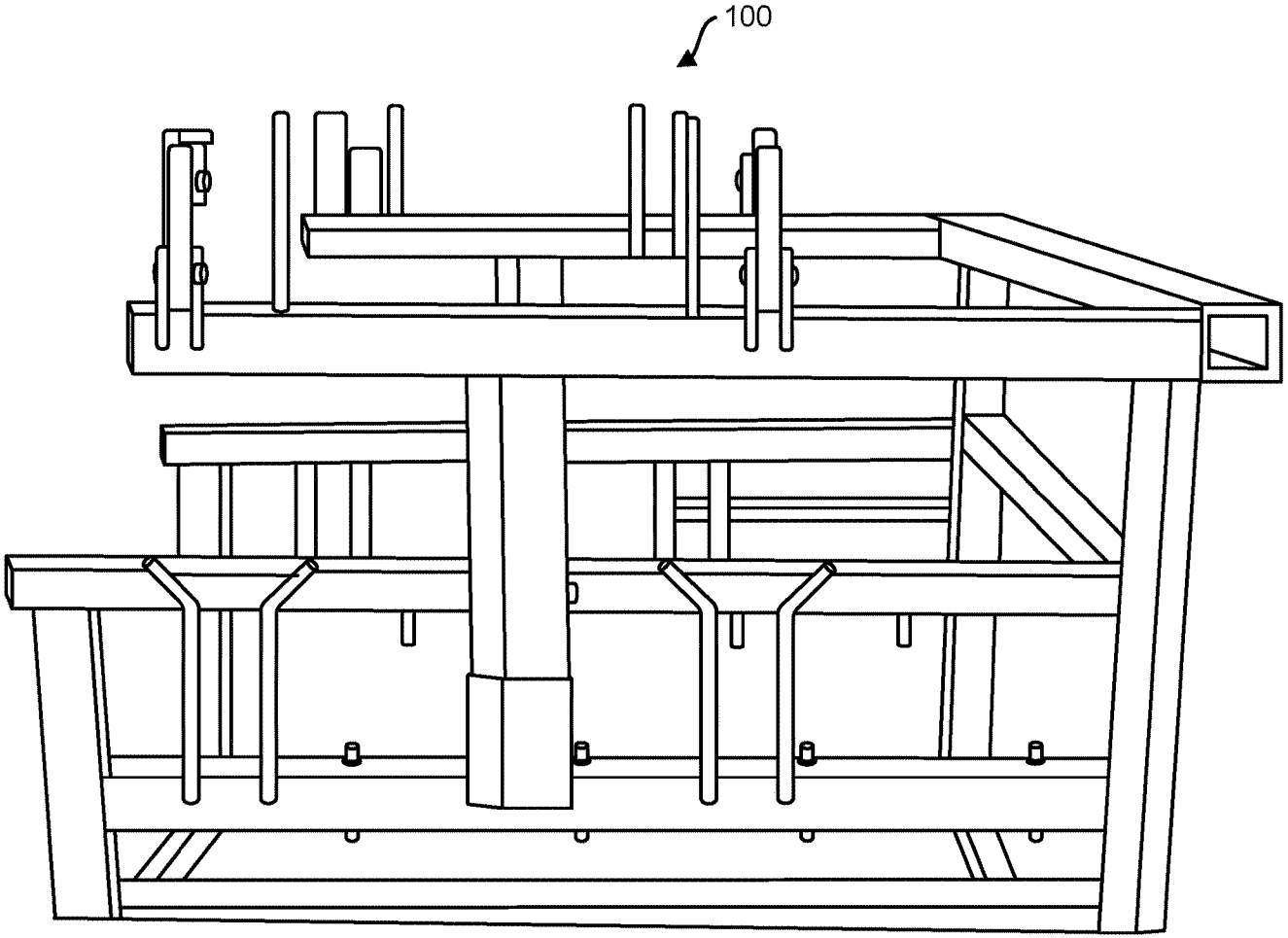
FIG. 5 illustrates a washing and maintenance support station for receiving parts of a filler apparatus in accordance with another embodiment.
Figure 6:
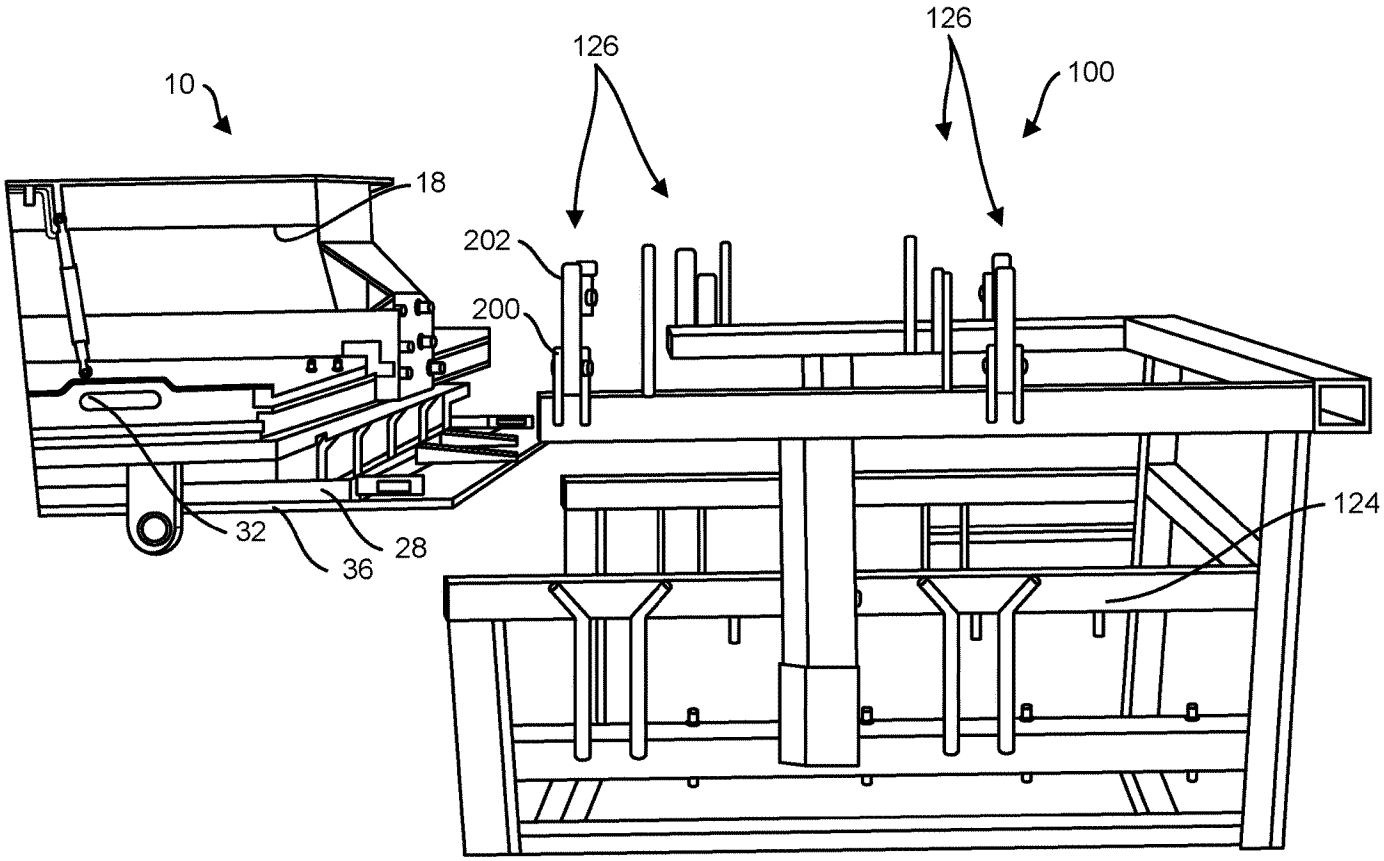
FIG. 6 illustrates the washing and maintenance support station of FIG. 5, where parts of the filler apparatus are to be installed on the support station.
Figure 7:
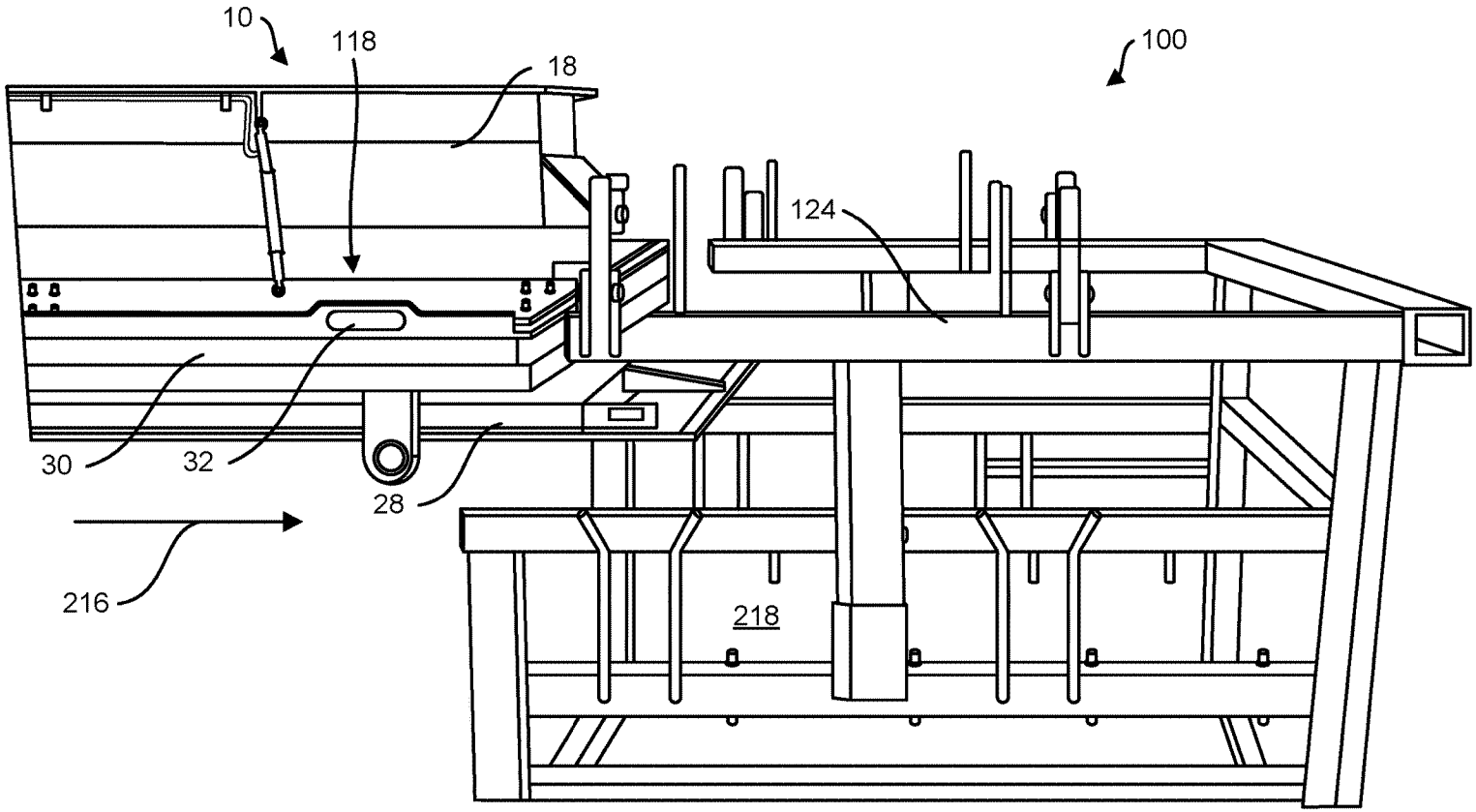
FIG. 7 illustrates the washing and maintenance support station of FIG. 5, where parts of the filler apparatus are aligned such as to be installed on the support station.
Figure 8:
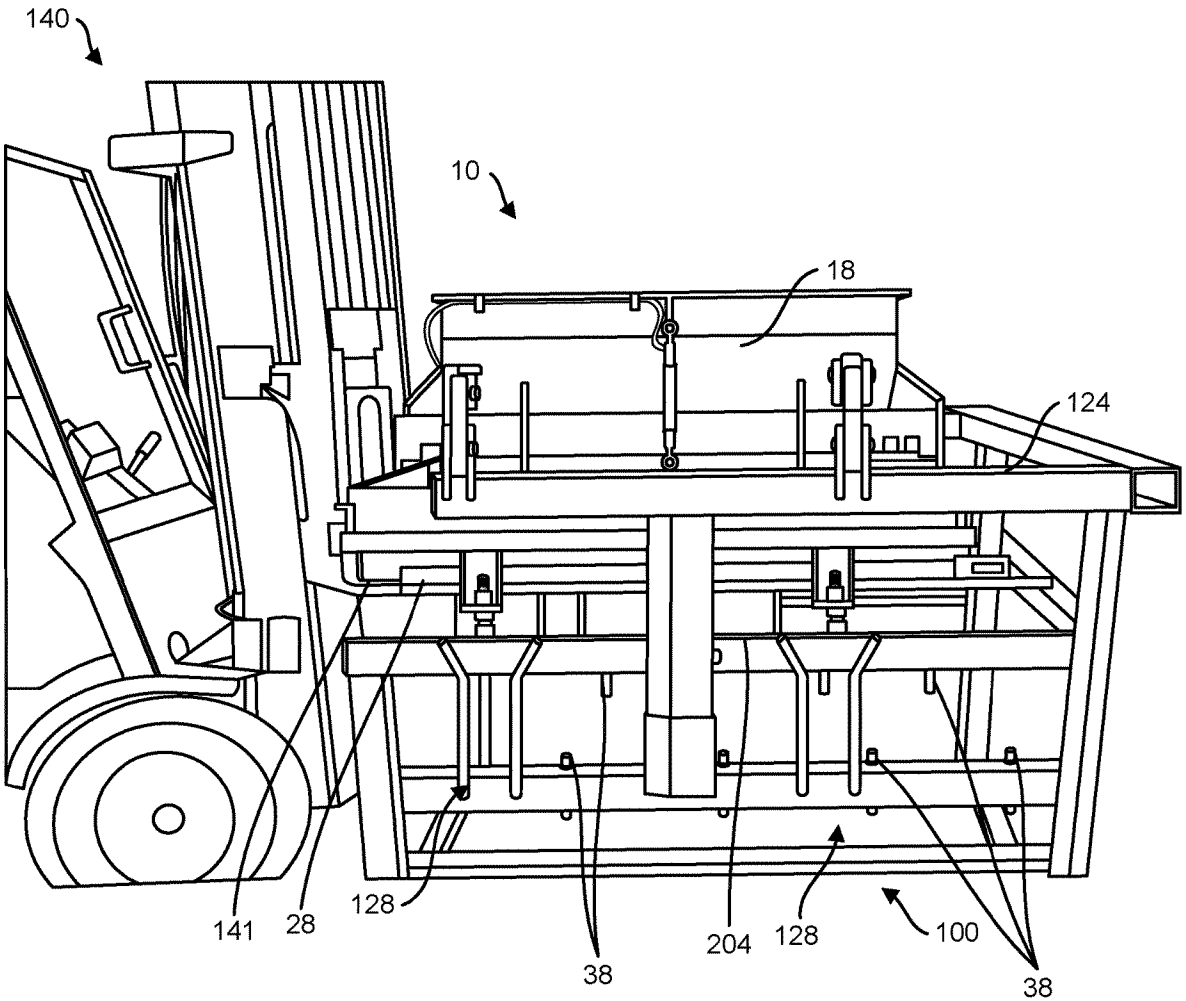
FIG. 8 illustrates the washing and maintenance support station of FIG. 5, where a filler container is in engagement with the support station.
Figure 9:
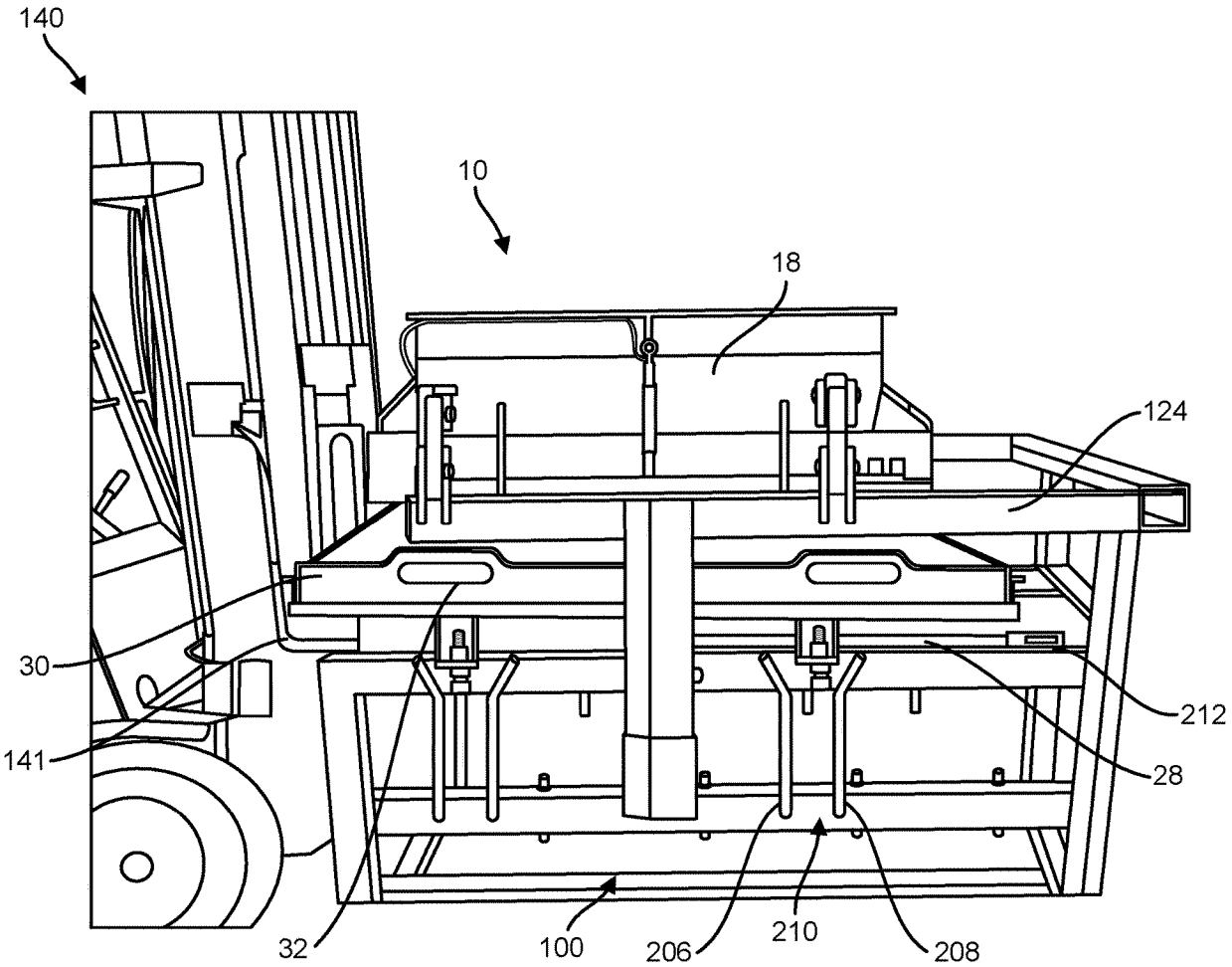
FIG. 9 illustrates the washing and maintenance support station of FIG. 5, where the filler container is in engagement with the support station and where a volumetric container is aligned such as to be mounted on the support station.
Figure 10:
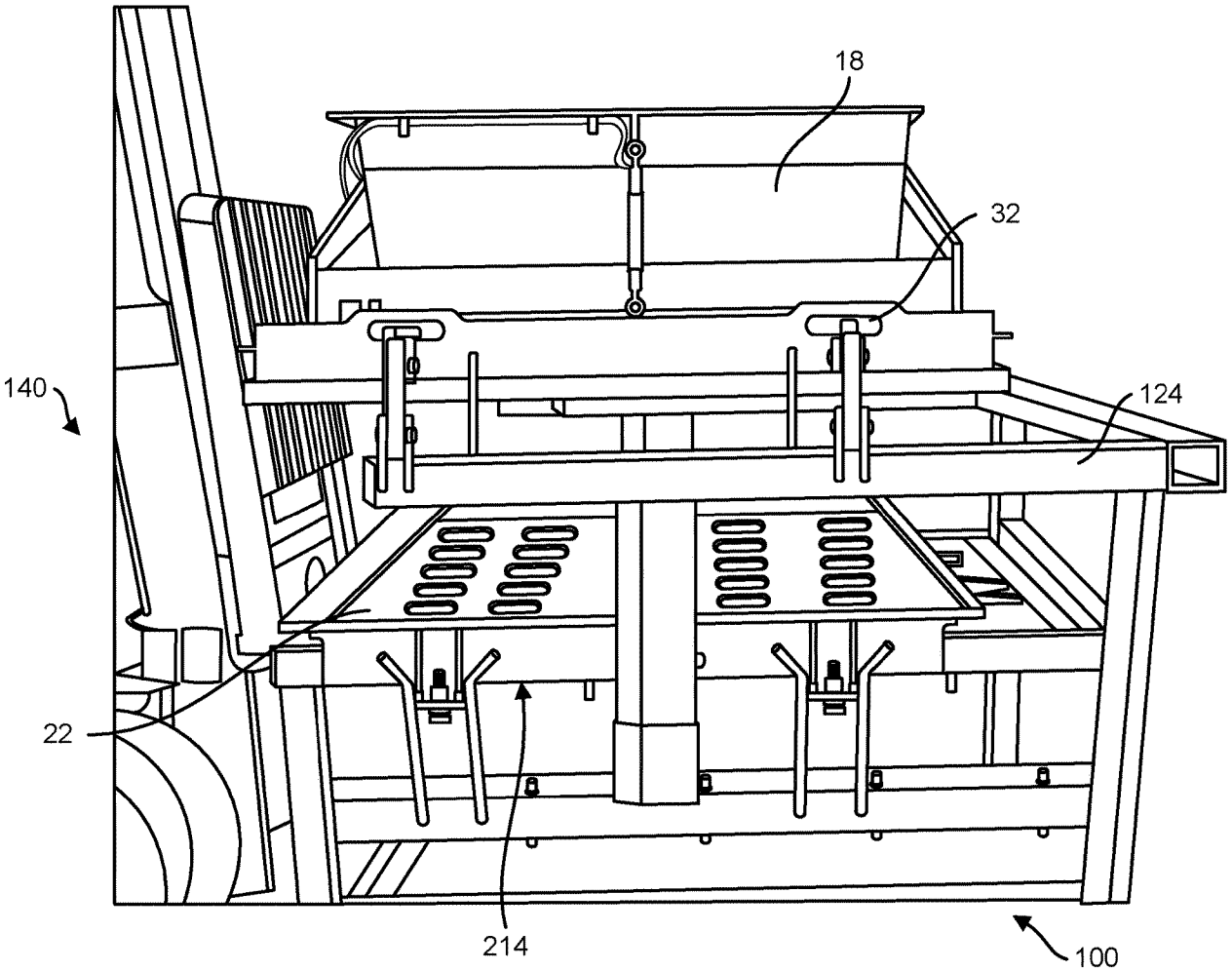
FIG. 10 illustrates the washing and maintenance support station of FIG. 5, where the filler container is in engagement with the support station and where the volumetric container is mounted on the support station below the filler container.
Figure 11:
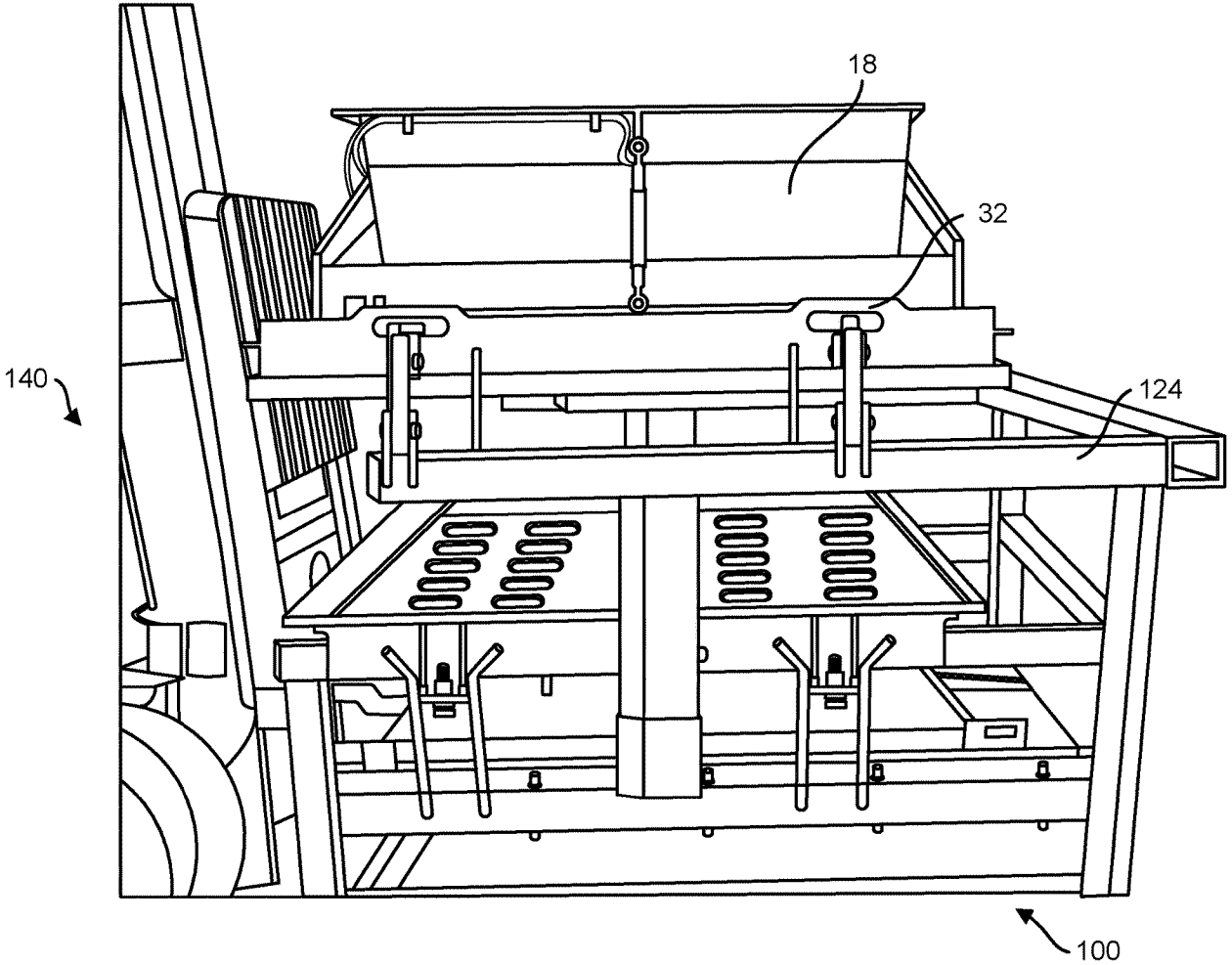
FIG. 11 illustrates the washing and maintenance support station of FIG. 5, where the filler container is in engagement with the support station, where the volumetric container is mounted on the support station below the filler container and where the sliding plate is supported by the support station below the filler container.

In accordance with another embodiment and referring now to FIGS. 5-11, there is shown the washing and maintenance support station 100 for receiving one or more parts from filler apparatus 10, which are the filler container 18, the volumetric container 22 and the sliding plate 28. The washing and maintenance support station 100 includes a support main frame 124 and corresponding mating connectors 126 on the support main frame 124 for releasably connecting/engaging with the mating connector 118 of the filler container 18. The corresponding mating connectors 126 may include, without limitation, latch sections, hook sections and the like on the support main frame 124. The washing and maintenance support station 100 further includes mount receiving sections 128 (i.e., such as ledges 128) on the support main frame 124 below the corresponding mating connectors 126 for releasably connecting with the mounts 120 and receiving support 38 on the support main frame 124 below the mount receiving sections 128 for releasably supporting the substantially flat section 36 of the sliding plate 28.

In operation, an operator, using a vehicle (i.e., such as, without limitation, a lift vehicle 140 with forward forks 141), a robot, a travelling crane, or an automated mechanism release the filler container 18, the volumetric container 22 and the sliding plate 28 from the main frame 16 of the filler apparatus 10. The operator needs to align the forward forks 141 of the lift vehicle 140 underneath the surface of the sliding plate 28 and to lift the parts of the filler apparatus 10 in an upwardly direction (i.e., the parts being the filler container 18, the volumetric container 22 and the sliding plate 28). Then, the operator, having the filler container 18, the volumetric container 22 and the sliding plate 28 supported by the forward forks 141 may circulate towards a washing and maintenance support station 100 which will receive these parts of the filler apparatus 10. The operator may want to release the parts from the filler apparatus 10 for washing purposes, for maintenance purposes, or simply for changing the volumetric container 22 such as to provide an alternative volumetric container 22 which have plurality of cavities of other shapes and configurations to created molded articles of different shapes and configurations.

According to another embodiment, at least one of the filler container 18, the volumetric container 22 and the sliding plate 28 may be displaced in a horizontal direction, a vertical direction, an angled direction, any combination and the like, relative to the main frame 16 of the filler apparatus 10 or to the support main frame 124 of the washing and maintenance support station 100 such as to dislodge the filler container 18, the volumetric container 22 or the sliding plate 28 from the main frame 16 of the filler apparatus 10 or from the support main frame 124.

According to another embodiment, the volumetric container mount receiving section 128 comprises a plurality of volumetric container mount receiving sections 128 for releasably mounting a plurality of volumetric container mounts 120. Each one of the plurality of volumetric container mount receiving sections 128 extends outwardly from the external frame portion 204 of the support main frame 124.

According to another embodiment, each one of the plurality of volumetric container mount receiving sections 128 may include a first plate member 206 and a second plate member 208 distant from the first plate member 206. The first and second plate members 206, 208 defines a mounting passage 210 for receiving a corresponding volumetric container mount 120.

According to another embodiment, the volumetric container mount receiving section 128 further includes a substantially flat receiving section 212 for receiving a bottom portion 214 of the volumetric container 22.

According to another embodiment, the sliding plate receiving support 38 includes a plurality of sliding plate receiving supports 38. Each one of the plurality of sliding plate receiving supports 38 inwardly extends from the support main frame 124 for defining a receiving plan for horizontally supporting the sliding plate 28.

According to another embodiment, the support main frame 124 defines a passage 216 for allowing the filler container 18, the volumetric container 22 and/or the sliding plate 28 of a filler apparatus 10 to access an internal section 218 defined by the support main frame 124.

According to another embodiment, the washing and maintenance support station 100 may be an automatized washing and maintenance support station 100 and may be, for example, designed as a dish washer, for receiving the filler container 18, the volumetric container 22 and the sliding plate 28.

Then, the operator needs to displace the forks 141 of his lift vehicle 140 such as to displace the filler container 18, the volumetric container 22 and the sliding plate 28 all together above the support main frame 124 of the washing and maintenance support station 100 and such as the mating connectors 118, and the mounts 120 of respectively the filler container 18 and the volumetric container 22 are aligned with their corresponding mating connectors 126 and mount receiving sections 128 on the support main frame 124 of the washing and maintenance support station 100. Once the parts of the filler apparatus 10 are aligned with the support main frame 124 of the washing and maintenance support station 100, the operator may drive up and down (i.e., vertically) the parts relative to the support main frame 124.

Firstly, driving up the parts relative to the support main frame 124, the corresponding mating connectors 126 (i.e., the four latches/hooks 126 upwardly extending from the support main frame 124) on the support main frame 124 will releasably connect/engage with the four openings 32 on the periphery of the supporting plate 30 supporting the filler container 18. Thus, when the operator continues by driving down the forks 141 of the lift vehicle 140, the filler container 18 will be held up by the corresponding mating connectors 126 (latch/hook sections 126) on the support main frame 124 of the washing and maintenance support station 100.

Secondly, when the operator continues to drive down the forks 141 of the lift vehicle 140, the mounts 120 (i.e., the four downwardly extending legs 120 extending from the volumetric container 22) of the volumetric container 22 will releasably mount on the four mount receiving sections (or ledges) 128 of the support main frame 124 of the washing and maintenance support station 100 (i.e., the mount receiving sections or ledges 128 outwardly extending from the support main frame 124 of the washing and maintenance support station 100) such as to provide the volumetric container 22 to introduce within the support main frame 124. Thus, when the operator continues to drive down the forks 141 of the lift vehicle 140, the volumetric container 22 will be held up by the mount receiving sections or ledges 128 on the support main frame 124 of the washing and maintenance support station 100 (i.e., via gravity forces applied on the downwardly extending mounts 120).

Thirdly, when the operator continues to drive down the forks 141 of the lift vehicle 140, the substantially flat section 36 defined by the sliding plate 28 will releasably be supported and/or be in interaction with the receiving support 38 of the support main frame 124 of the washing and maintenance support station 100 (i.e., the receiving support 38 of flat section 36 defined by the support main frame 124 of the washing and maintenance support station 100). Thus, when the operator continues to drive down the forks 141 of the lift vehicle 140, the sliding plate 28 will be hold back and supported by the receiving support 38 on the support main frame 124 of the washing and maintenance support station 100 (i.e., via gravity forces applied on the sliding plate 28).

Thus, when the parts (i.e., the filler container 18, the volumetric container 22 and the sliding plate 28) are releasably mounted on the washing and maintenance support station 100, it may be possible for the operator to wash and/or repair these parts. This allows the operator to continuously operate the molding process without having to stop the plant for maintenance.

On the other hand, when all the parts are washed and/or repaired and/or replaced, the operator may circulate with his lift vehicle 140 towards the washing and maintenance support station 100 which holds/support/connect the filler container 18, the volumetric container 22 and/or the sliding plate 28.

When the operator drives up the forks 141 of the lift vehicle 140, the substantially flat section 36 defined by the sliding plate 28 will release from (unsupported by) the receiving support 138 of the support main frame 124 of the washing and maintenance support station 100. Thus, when the operator continues to drive up the forks 141 of the lift vehicle 140, the sliding plate 28 will be supported by the forks 141 of the lift vehicle 140.

Moreover, when the operator continues to drive up the forks 141 of the lift vehicle 140, the mounts 120 (i.e., the four downwardly extending legs 120 extending from the volumetric container 22) of the volumetric container 22 will release from the mount receiving sections or ledges 128 of the support main frame 124 (i.e., the four volumetric container ledges 128 outwardly extending from the support main frame 124 of the washing and maintenance support station 100). Thus, when the operator continues to drive up the forks 141 of the lift vehicle 140, the volumetric container 22 and the sliding plate 28 will be supported by the forks 141 of the lift vehicle 140.

When the operator continues to drive up the forks 141 of the lift vehicle 140, the corresponding mating connectors 126 (latch/hook sections 126) (i.e., the four latches/hooks 126 upwardly extending from the support main frame 124) on the support main frame 124 will release from the openings 32 on the periphery of the supporting plate 30 supporting the filler container 18. Thus, when the operator continues to drive up the forks 141 of the lift vehicle 140, the filler container 18, the volumetric container 22 and the sliding plate 28 will be held back and supported by the forks 141 of the lift vehicle 140.

Then, the operator may circulate away from the washing and maintenance support station 100 and if he wants to reinstall the parts on the main frame 16 of the filler apparatus 10, he may need to align the forks 141 of his lift vehicle 140 such as to displace the filler container 18, the volumetric container 22 and the sliding plate 28 all together above the main frame 16 of the filler container 18 and such as the mounts 120 of the volumetric container 22 are aligned with their corresponding mount receiving sections 42 on the main frame 16 of the filler apparatus 10. Once the mounts 120 of the volumetric container 22 are aligned with the main frame 16, the operator may drive down the parts toward the main frame 16 of the filler apparatus 10 and drive back/forward the lift vehicle 140. The filler apparatus 10 and thus the molding process may then be used again.

It is to be noted that one or more from: the filler container 18, the volumetric container 22 and the sliding plate 28 may be releasably mounted/connected/supported from, to and by the main frame 16 of the filler apparatus 10 and the support main frame 124 of the washing and maintenance support station 100. Furthermore, it is to be mentioned that any suitable flat section 36, receiving supports 38, mating connectors 118, mount 120, mating connectors 126, and mount receiving sections 128 on the filler apparatus 10, the washing and maintenance support station 100, the filler container 18, the volumetric container 22 and/or the sliding plate 28 may be suitable such as it allows a person and/or a lift vehicle 140 to releasably connect, one or more parts of the filler apparatus 10 at the same time. It is also to be mentioned that while the flat section 36, receiving supports 38, mating connectors 118, mount 120, mating connectors 126, and mount receiving sections 128 are configured such as to allow an operator to move downwardly the forks 141 of the lift vehicle 140 to releasably connect the parts on the support main frame 124 of the washing and maintenance support station 100, it is possible that the flat section 36, receiving supports 38, mating connectors 118, mount 120, mating connectors 126, and mount receiving sections 128 are configured such as to allow the operator to move up the forks 141 of the lift vehicle 140 to releasably connect the parts on the support main frame 124 of the washing and maintenance support station 100.

According to another embodiment and referring to FIGS. 6-11, there is provided a method for disengaging/engaging the parts of the filler apparatus 10 from each other, the filler apparatus comprising the filler container 18, the volumetric container 22 and the sliding plate 28. The method includes displacing vertically relative to the support main frame 124 the filler container 18, the volumetric container 22 and the sliding plate 28 while, firstly engaging the filler container 18 with the support main frame 124, secondly engaging the volumetric container 22 with the support main frame 124 below the filler container 18, and thirdly engaging the sliding plate 28 with the support main frame 124 below the volumetric container 22 thereby resulting in the parts of the filler apparatus being separated from each other where the order from top to bottom is: the filler container, the volumetric container and the sliding plate.

According to another embodiment, the method may further include washing and/or maintaining the filler container 18, the volumetric container 22 and/or the sliding plate 28.

According to another embodiment, the method further includes engaging the parts of the filler apparatus by: displacing upwardly relative to the support main frame 124 the sliding plate 28, displacing upwardly relative to the support main frame 124 the sliding plate 28 supporting the volumetric container 22, and displacing upwardly relative to the support main frame 124 the sliding plate 28 and the volumetric container 22 supporting the filler container 18.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A filler apparatus to be mounted on at least one of a main frame and a support station defining a mount receiving section extending therefrom, the filler apparatus comprising:

a sliding plate;

a volumetric container adapted for releasable engagement with and above the sliding plate; and a filler container for receiving a moldable material and adapted for releasable engagement with and above the volumetric container, the volumetric container for receiving the moldable material from the filler container;

wherein at least one of the filler container, the volumetric container and the sliding plate is adapted for releasable mounting and alignment with the mount receiving section of the at least one of the main frame and the support station; and further wherein the filler container, the volumetric container and the sliding plate are, when displaced vertically, releasably engageable to and disengageable from the at least one of the main frame and the support station as a single sub-assembly;

wherein the filler apparatus further comprises a separate supporting plate supporting the filler container and defining a mating connector for releasably connecting with a corresponding mating connector on the support station.

2. The filler apparatus of claim 1, wherein the mating connector comprises a plurality of mating connectors for releasably connecting with a plurality of mating connectors on the support station.

3. The filler apparatus of claim 1, wherein the corresponding mating connector comprises at least one of: a hook section and a latch section, and further wherein the mating connector comprises an opening for releasably connecting with the at least one of: a hook section and a latch section.

4. The filler apparatus of claim 1, wherein the volumetric container comprises a mount for releasably mounting on the mount receiving section of the at least one of the main frame and the support station.

5. The filler apparatus of claim 4, wherein the mount comprises a plurality of mounts for releasably mounting on a plurality of mount receiving sections of the at least one of: a main frame and a support station.

6. The filler apparatus of claim 1, wherein the sliding plate comprises a substantially flat section to be supported by a receiving support of at least one of the main frame and the support station.

7. The filler apparatus of claim 1, wherein the volumetric container comprises one or more mold openings for receiving the moldable material from the filler container.

8. The filler apparatus of claim 7, wherein each of the one or more mold openings defines a mold opening volume for release to a mold below the filler apparatus.

9. The filler apparatus of claim 8, wherein the sliding plate is slidable between a filling position and a releasing position, where, in the filling position, the moldable material is held in the one or more mold openings, while, in the releasing position, the moldable material is released to the mold below the filler apparatus.

* * * * *